US006499417B2

(12) United States Patent
Oliver et al.

(10) Patent No.: US 6,499,417 B2
(45) Date of Patent: Dec. 31, 2002

(54) TORPEDO MOUNTED DISPENSER FOR A COIL OF FLEX HOSE AND CONTROL WIRE

(75) Inventors: Stephen F. Oliver, Portsmouth, RI (US); Stanley J. Olson, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 19 days.

(21) Appl. No.: 09/785,996

(22) Filed: Feb. 20, 2001

(65) Prior Publication Data

US 2002/0112656 A1 Aug. 22, 2002

(51) Int. Cl.[7] ..... F41F 3/10
(52) U.S. Cl. ..... 114/238; 114/21.1; 114/21.2
(58) Field of Search ..... 114/20.1, 21.1, 114/21.2, 238, 246, 253; 89/1.81, 1.816; 244/3.12

(56) References Cited

U.S. PATENT DOCUMENTS 3,265,023 A * 8/1966 Hollingsworth ..... 114/20.1
3,703,874 A * 11/1972 Lemieux ..... 114/21 R
4,165,876 A * 8/1979 Pasqualini ..... 273/105.3
5,385,109 A * 1/1995 Hrycin et al. ..... 114/238

* cited by examiner

*Primary Examiner*—Michael Carone
*Assistant Examiner*—H. A. Blackner
(74) *Attorney, Agent, or Firm*—Michael J. McGowan; James M. Kasischke; Michael F. Oglo

(57) ABSTRACT

A torpedo mounted dispenser for a coil of flex hose and control wire includes a rigid shell round in widthwise cross section, and a circular shock mount disposed centrally of the shell, the shell and the shock mount defining an annular chamber therebetween. Hooks are mounted on an exterior wall of the shell. Slots are defined by the shell, each slot being proximate one of the hooks. A retainer ring is disposed in the chamber. Retainer loops each extend at least partly around the retainer ring, through one of the slots, and is attached to one of the hooks. The coil of flex hose and control wire is disposed in the chamber and is movable lengthwise through the retainer ring while uncoiling and paying out from the dispenser.

6 Claims, 6 Drawing Sheets

TORPEDO MOUNTED DISPENSER FOR A COIL OF FLEX HOSE AND CONTROL WIRE

STATEMENT OF GOVERNMENT INTEREST

The invention described herein may be manufactured and used by and for the Government of the United States of America for Governmental purposes without the payment of any royalties thereon or therefor.

BACKGROUND OF THE INVENTION (1) Field of the Invention

The invention relates to guidance and control systems for torpedoes, and is directed more particularly to a torpedo mounted dispenser for paying out a flex hose and control wire from the dispenser during travel of the torpedo from a launch tube toward a target.

(2) Description of the Prior Art

Heavyweight torpedoes launched by submerged submarines against other submarines or surface vessels are well known. Such torpedoes are noted for their speed and accuracy. A guidance and control wire is coiled in the torpedo fuel tank and extends therefrom through a connector external to the torpedo. A dispenser is mounted on the aft end of the torpedo and is adapted to part from the torpedo upon launch of the torpedo. The dispenser has mounted therein a further annularly coiled control wire which, before launch of the torpedo, passes through the aforesaid connector. As the torpedo travels from the submarine launch tube toward a target, the wire in the torpedo fuel tank pays out of the torpedo, and the flex hose and wire coiled in the dispenser pays out. Both wires, connected together, hang downwardly from the torpedo and the submarine, and maintain communication between the submarine and the torpedo, permitting course changes and other commands to be directed from the submarine while the torpedo is in transit.

Referring to FIG. 1, it will be seen that the torpedo mounted dispenser (TMD) 10 is mounted on the torpedo 12 when the torpedo is loaded into a launch tube (not shown). The TMD 10 is disconnectably attached to the torpedo 12, such that upon launch of the torpedo, the TMD which is fastened in the launch tube, parts from the torpedo and remains in the launch tube. A control wire 14 is mounted in the torpedo 12 so as to pay out from a passageway 16 in the torpedo. A fair-lead 18 is fixed to passageway 16 in torpedo 12 allowing torpedo control wire 14 to pay out therethrough.

Referring to FIG. 2, it will be seen in a illustrative prior art TMD 10 having a flex hose 20 and a TMD control wire 22, the flex hose 20 is coiled around a shock mount 24 and in a wire coil chamber 38 inside circular shell 26. A wire inlet end of the flex hose 20 is secured in wire coil chamber 38 inside TMD 10. A flex hose connector 28 at the outlet end of the flex hose 20 is adapted for connection to the fair lead 18 (FIG. 1). Thus, prior to launch, control wire 22 is stored within wire coil chamber 38, passes into flex hose 20 in the TMD 10 and passes out of flex hose connector 28.

TMD control wire 22 is spliced to torpedo control wire 14, using a splice sleeve 15 crimped onto both control wires 14, 22, after TMD 10 is mounted on the torpedo 12. After mounting TMD, flex hose connector 28 is assembled over fair lead 18 with shear screws. The shear screws allow flex hose 20 separation from fair lead 18 when the flex hose 20 is fully extended. After separation, spliced torpedo control wire 14 and TMD control wire 22 pay out from their respective coils as the torpedo moves through the water, the two control wires 14, 22 being connected to form a single communication wire extending between the submarine and the torpedo. Flex hose 20 remains attached to TMD 10 during torpedo transit and sinks below the submarine for protecting the wire exiting from the TMD wire coil chamber 38 through hose 20.

Still referring to FIG. 2, it will be seen that the prior art TMD is provided with elastomeric retainer rings 30, 32 which serve to restrain the pay-out of flex hose 20, such that the flex hose is dispensed in a controlled manner, without tangling of the flex hose, or bunching up thereof, in unwinding from around the shock mount 24. Flex hose 20 or flex hose connector 28 must be positioned inside the inner diameter of retainers 30 arrangement prevents flex hose connecter 28 from hanging on retainers 30 and 32 as flex hose 20 is deployed.

The retainer rings 30, 32 are mounted by passing through U-shaped slots 34 in the shell 26 (FIGS. 1 and 2) and passing over and into hooks 36. Each retainer ring 30, 32 is stretched to engage with two opposite hooks 36.

In practice, it has been found that on occasion the retainer rings 30, 32 fail to remain between the shock mount 24 and the shell 26, and extend out over the shock mount 24, causing the flex hose 20 to be directed inwardly toward the axis of the shockmount 24, rather than paying out around the periphery of the shock mount, increasing friction and noise of paying-out.

In addition, the TMD devices are customarily stored in torpedo rooms in submarines for long periods of time, attached to torpedoes. The elastomeric material of the retainer rings deteriorates over time and snaps, making an audible noise and debilitating the retainer pay-out control function. Continual inspection is required. Accordingly, it is necessary under such conditions to separate the TMD from the torpedo and effect replacement of the failed retainer rings if spares are available on board.

SUMMARY OF THE INVENTION

An object of the invention is, therefore, to provide an improved torpedo mounted dispenser having a retainer means which controls the pay-out of the flex hose and which resists deterioration and resists displacement during operation.

With the above and other objects in view, as will hereinafter appear, a feature of the present invention is the provision of a torpedo mounted dispenser for a coil of flex hose and control wire, and centrally contained wire coil inside a cylindrical structure. The dispenser comprises a rigid shell round in widthwise cross section, a circular shock mount fixed within the shell and mounted centrally of the shell, the shell and the shock mount defining an annular chamber therebetween. The wire coil is contained in a central cylindrical structure of the TMD. Hooks are mounted on an exterior wall of the shell and slots are defined by the shell respectively proximate the hooks. A retainer ring is disposed in the chamber, and retainer loops each extend around at least a portion of the retainer ring, through one of the slots, and is attached to one of the hooks. The coil of flex hose and control wire is disposed in the annular chamber and is movable lengthwise through the retainer ring while uncoiling.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENT

Figure 1:
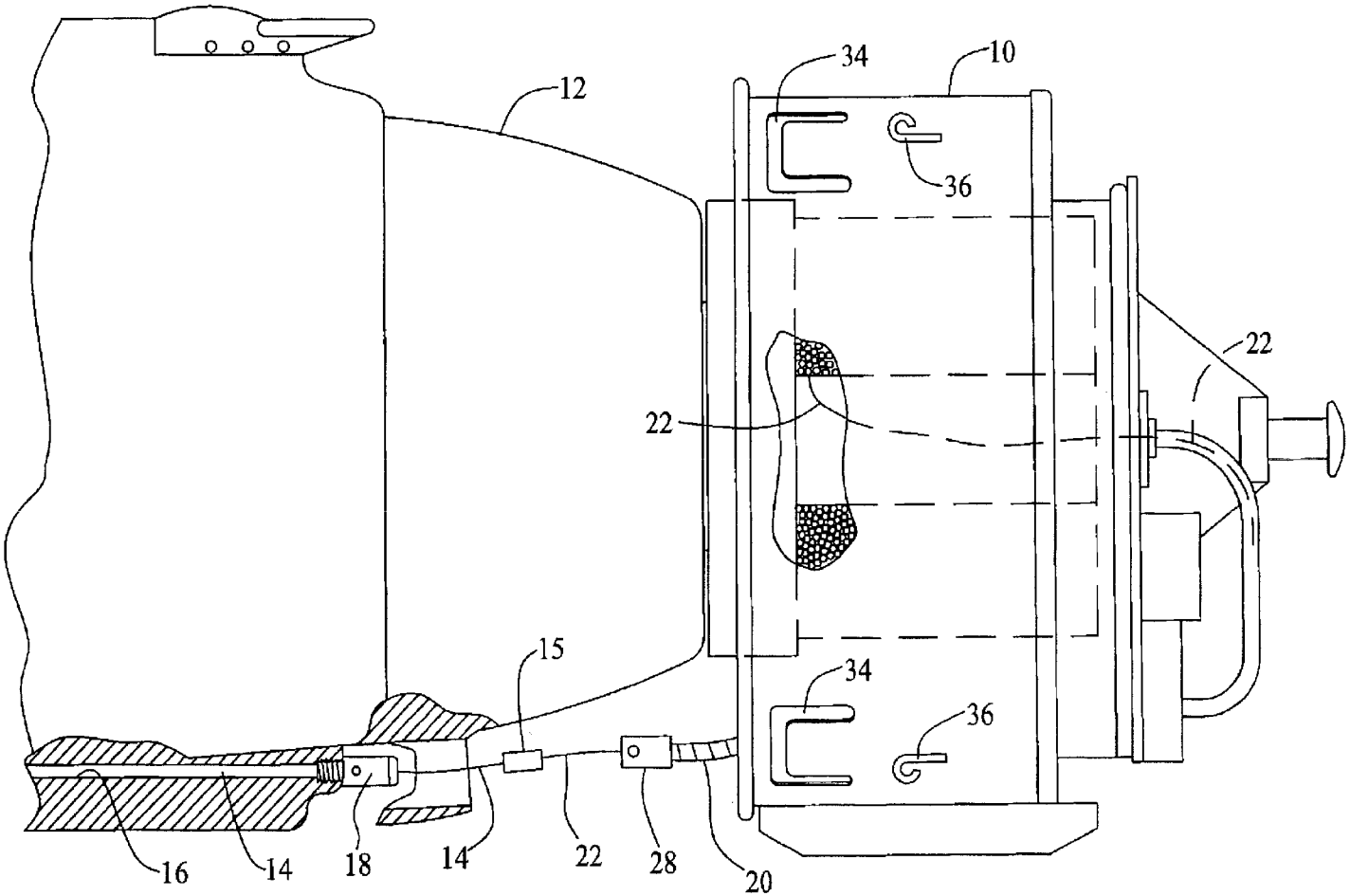
FIG. 1 PRIOR ART
FIG. 1 is a side elevational view, partly broken away, of an aft portion of a torpedo and prior art torpedo mounted dispenser connected together.
Figure 2:
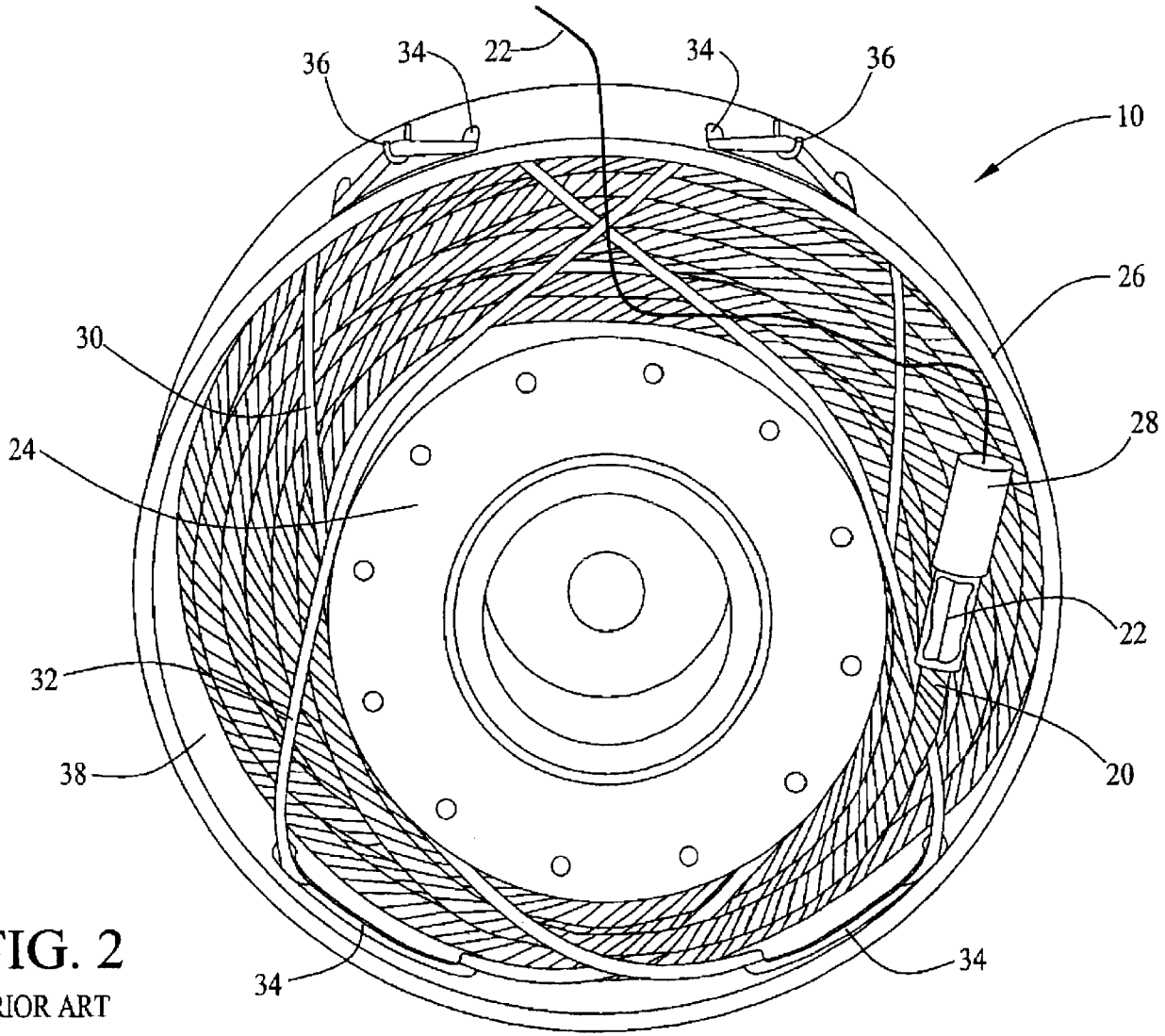
FIG. 2 PRIOR ART
FIG. 2 is a rear elevational view of a prior art torpedo mounted dispenser for a coil of flex hose and control wire.
Figure 3:
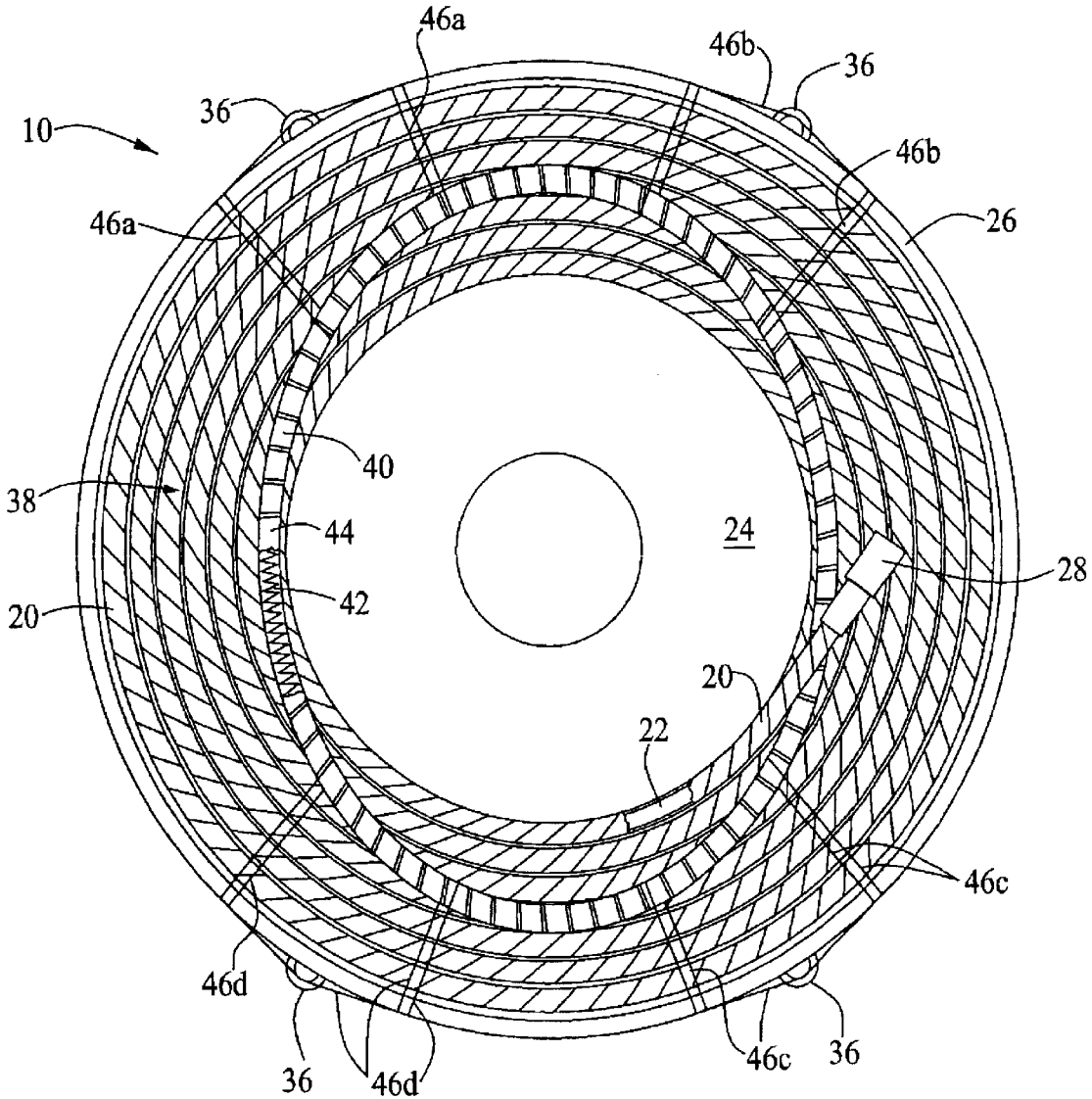
FIG. 3 is a rear elevational view, in part broken away, of one form of torpedo mounted dispenser illustrative of an embodiment of the invention.

Referring to FIG. 3, it will be seen that the illustrative dispenser 10 is similar to that shown in FIG. 2, and the flexhose 20 and control wire 22 are coiled in an annular chamber 38 defined by the shock mount 24 and the shell 26, as in the FIG. 2 dispenser.

However, a coil spring retainer ring 40 (FIGS. 3 and 4) is disposed around the shock mount 24. The retainer ring 40 comprises a stainless steel coil spring 42 (FIG. 3) covered by a protective jacket 44 of plastic material, or the like.

The retainer ring 40 is held in place by wire retainer loops 46*a*, 46*b*, 46*c*, and 46*d*. Each of the wire loops 46 extends around the retainer ring 40 and through one of the slots 34, (FIG. 4) and is mounted on one of the hooks 36 (FIGS. 5–7).

The two 180° spaces between the retainer ring 40 and shock mount 24 provide space for the retaining ring to retract and maintain contact with the remaining flex hose coiled surface. The wire loops 46 may be covered by a coating or layer of plastic material to reduce payout noise and friction. As is shown in FIGS. 5 and 6, crimps 50 may be used to fix portions of the retainer loops 46 to other portions thereof.

Figure 4:
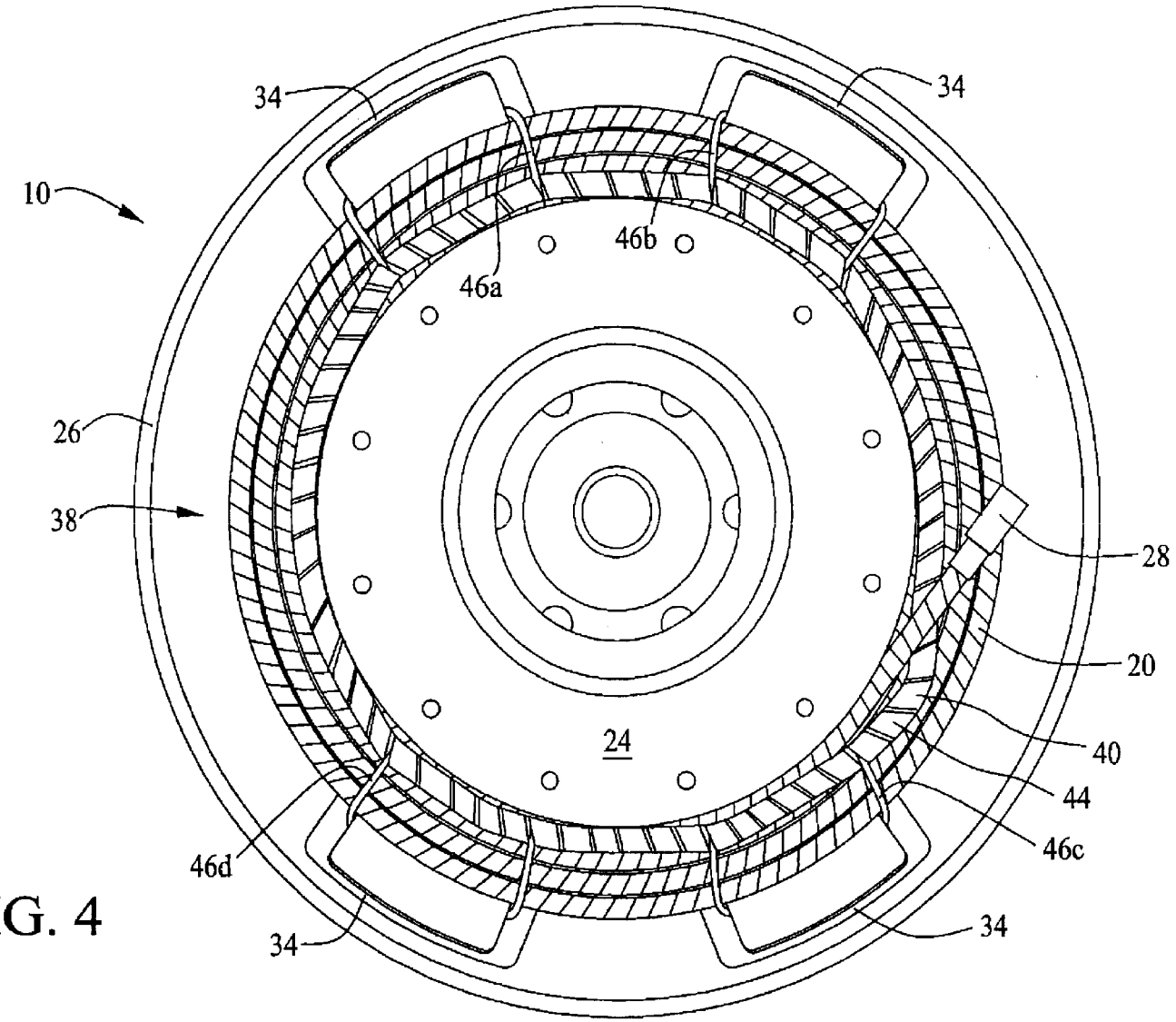
FIG. 4 is a perspective view of the dispenser of FIG. 3.
Figure 5:
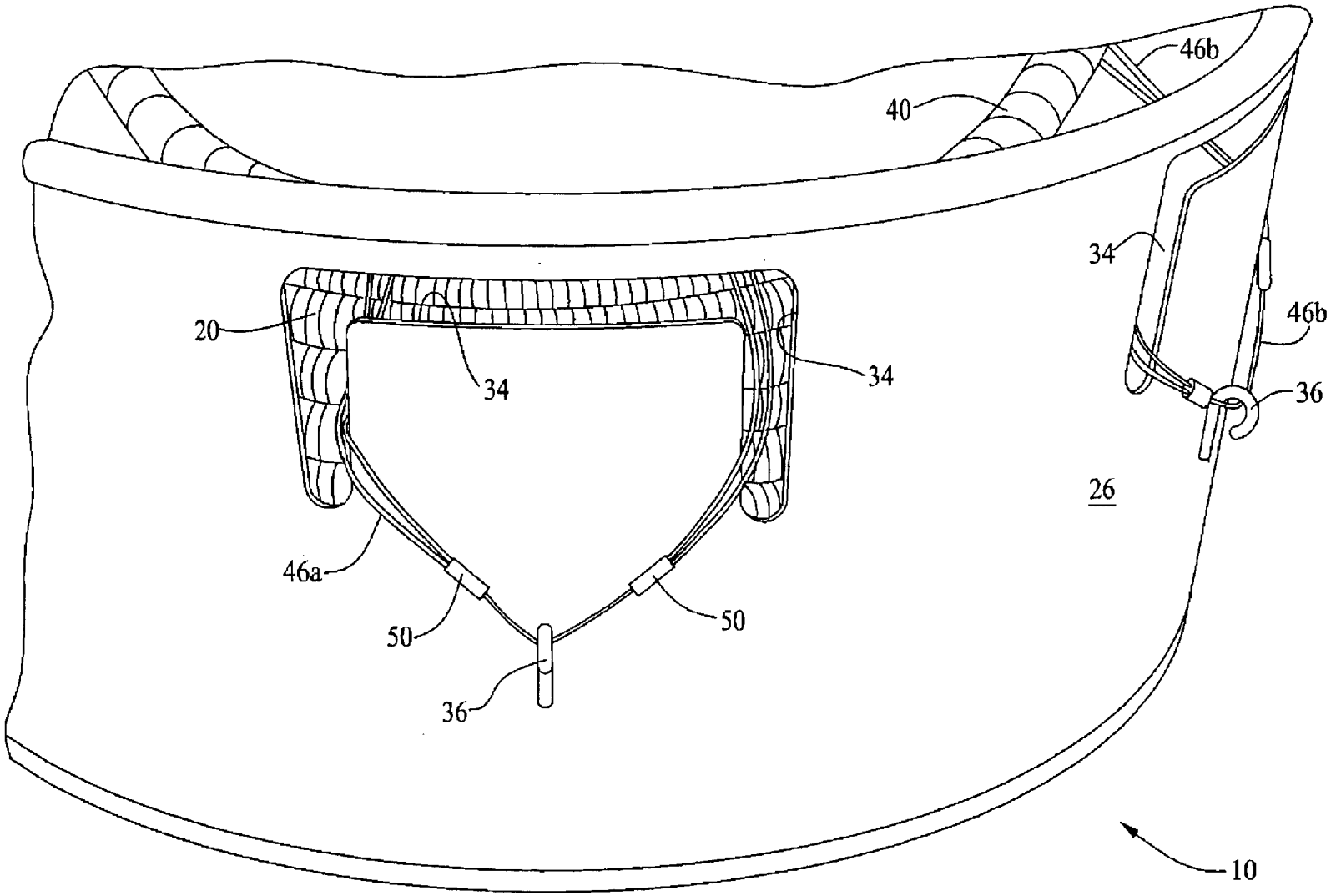
FIGS. 5–7 are perspective views which illustrate alternative means for fastening flex hose retaining loops on dispenser wall mounted hooks.
Figure 6:
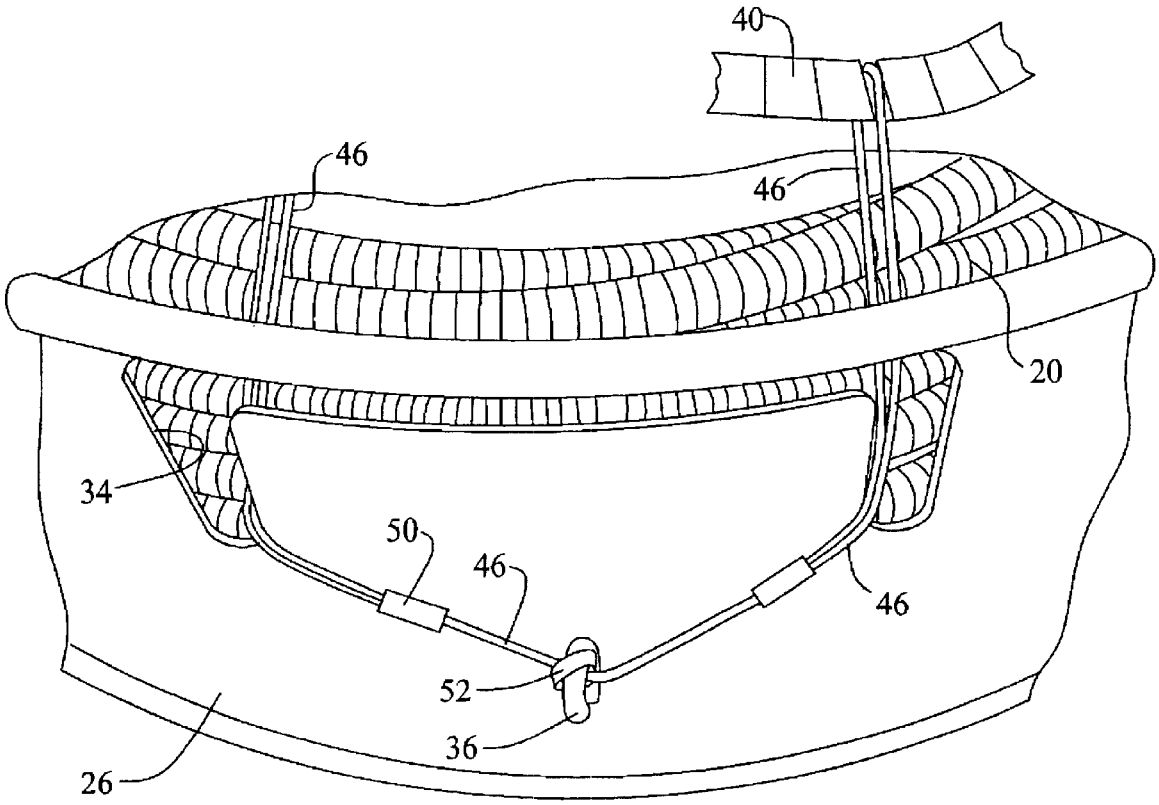

As shown in FIGS. 4 and 6, the wire retainer loops 46 may loop around a portion of the coil spring 42, rather than around the entire retainer ring 40. A clamp 52 (FIG. 6) may be disposed around the hook 36 and wire loop retainer 46 to further fix the loop to the hook 36. The clamp 52 can be a plastic or metal wire tie or crimped device.

Figure 7:
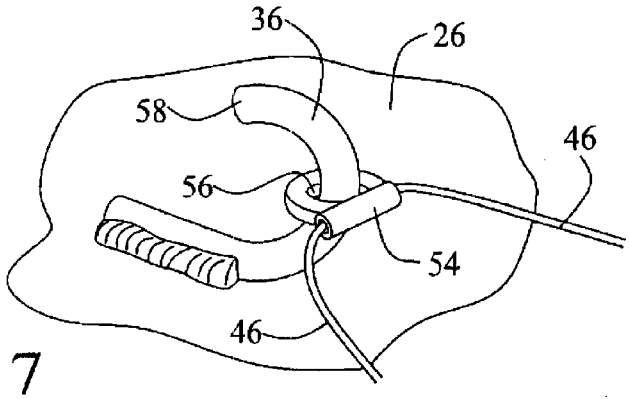

Referring to FIG. 7, there is shown a clip 54 slidably mounted on a retainer loop 46 and having an orifice 56 therein to serve to attach the clip 54 onto the hook 36. The clip 54 may be placed on the hook 36 by moving the orifice 56 over the hook free end 58.

While some examples of loop and hook attachments are shown in FIGS. 5–7, it will be apparent that the retainer loops 46 may be simply looped over the hooks 36, or may be connected to the hooks in the alternative ways shown, or through any selected means for securing a wire to a hook so that the wire will be retained under tension or slack conditions.

In operation, launch of a torpedo causes the torpedo to part from the TMD, the torpedo traveling through water toward a target, and the TMD remaining in the torpedo tube. The control wire pays out from the torpedo and from the TMD, the wire sinking downwardly, out of the way of the torpedo level and direction of travel and the submarine level and direction of travel. During travel of the torpedo, course changes and other commands may be communicated to the torpedo from the submarine. As the TMD flex hose pays out, it is retained within the confines of the retainer ring 40, which is sufficiently flexible to permit the flex hose to move out with ease, but substantial enough to remain in place and not be displaced by the outgoing flex hose. In due course, the control wire snaps at some point due to stress or a coil depletion, with a portion thereof possibly trailing behind the torpedo and a portion possibly hanging from the flex hose and out the torpedo tube. Both the flex hose and any control wire is sheared off during closing of the torpedo tube outer door. When the torpedo tube is pumped dry, the inner door is opened and the TMD with residual flex hose and control wire is removed.

Inasmuch as the retainer ring 40 is of stainless steel, there is virtually no deterioration. Similarly, inasmuch as the retainer loops 46 are of stainless steel wire, there is little or no deterioration over the normal periods of deployment and well beyond.

There is thus provided an improved TMD featuring a retainer ring which does not suddenly break and "ping" during a deployment, and which, during operation, maintains its proper position in the TMD.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A torpedo mounted dispenser for a coil of flex hose and control wire, said dispenser comprising:

a rigid shell round in widthwise cross section;

a circular shock mount fixed in said shell and mounted centrally of said shell, said shell and said shock mount defining an annular chamber therebetween;

hooks mounted on an exterior wall of said shell;

slots defined by said shell respectively proximate said hooks;

a retainer ring disposed in the annular chamber; and retainer loops, each extending around at least a portion of said retainer ring, through one of said slots, and attached to one of said hooks, said retainer ring being held in place by said retainer loops wherein the coil of flex hose and control wire is disposed in the annular chamber and is movable lengthwise through said retainer ring while uncoiling.

2. The dispenser in accordance with claim 1 wherein said retainer ring is a flexible coil spring.

3. The dispenser in accordance with claim 2 wherein said retainer ring coil spring is of stainless steel.

4. The dispenser in accordance with claim 3 wherein said retainer loops are wire cables.

5. A torpedo mounted dispenser for a coil of flex hose and control wire, said dispenser comprising:

a rigid shell round in widthwise cross section;

a circular shock mount fixed in said shell and mounted centrally of said shell, said shell and said shock mount defining an annular chamber therebetween;

hooks mounted on an exterior wall of said shell;

slots defined by said shell respectively proximate said hooks;

a retainer ring disposed in the annular chamber; and retainer loops, each extending around at least a portion of said retainer ring, through one of said slots, and attached to one of said hooks;

a retainer clip slidably mounted on each of said retainer loops, said retainer clip defining an orifice, and one of said hooks extending through said orifice to lock said retainer clip on said one hook;

wherein the coil of flex hose and control wire is disposed in the annular chamber and is movable lengthwise through said retainer ring while uncoiling.

6. A torpedo mounted dispenser for a coil of flex hose and control wire, said dispenser comprising:

rigid shell round in widthwise cross section;

a circular shock mount fixed in said shell and mounted centrally of said shell, said shell, and said shock mount defining an annular chamber therebetween;

hooks mounted on an exterior wall of said shell;

slots defined by said shell respectively proximate said hooks;

a retainer ring disposed in the annular chamber; and retainer loops, each extending around at least a portion of said retainer ring, through one of said slots, and attached to one of said hooks;

a clamp means for clamping said retainer loops to said hooks;

wherein the coil of flex hose and control wire is disposed in the annular chamber and is movable lengthwise through said retainer ring while uncoiling.

* * * * *